US007025561B2

(12) United States Patent
Honda et al.

(10) Patent No.: US 7,025,561 B2
(45) Date of Patent: Apr. 11, 2006

(54) FUEL PUMP

(75) Inventors: Yoshihiko Honda, Obu (JP); Kazumichi Hanai, Obu (JP); Koichi Iwata, Obu (JP)

(73) Assignee: Aisan Kogyo Kabushiki Kaisha, Obu (JP)

( * ) Notice: Subject to any disclaimer, the term of this patent is extended or adjusted under 35 U.S.C. 154(b) by 58 days.

(21) Appl. No.: 10/867,637

(22) Filed: Jun. 16, 2004

(65) Prior Publication Data

US 2004/0258515 A1 Dec. 23, 2004

(30) Foreign Application Priority Data

Jun. 23, 2003 (JP) ..... 2003-177906

(51) Int. Cl.
*F04D 17/06* (2006.01)

(52) U.S. Cl. ..... 415/55.1

(58) Field of Classification Search ..... 415/55.1–55.6
See application file for complete search history.

(56) References Cited

U.S. PATENT DOCUMENTS

| | | | | |
|---|---|---|---|---|
| 5,486,087 | A | 1/1996 | Treiber et al. | |
| 5,551,835 | A * | 9/1996 | Yu et al. | 415/55.1 |
| 6,068,456 | A * | 5/2000 | Tuckey et al. | 417/423.3 |

FOREIGN PATENT DOCUMENTS

| | | |
|---|---|---|
| DE | 44 18 640 | 12/1994 |
| DE | 196 43 728 | 4/1998 |
| DE | 197 57 580 | 7/1999 |
| JP | 08-014184 | 1/1996 |

OTHER PUBLICATIONS

U.S. Appl. No. 10/808,638, unpublished, Honda et al.
U.S. Appl. No. 10/851,732, unpublished, Ikeya.

* cited by examiner

*Primary Examiner*—Ninh H. Nguyen
(74) *Attorney, Agent, or Firm*—Dennison, Schultz, Dougherty & MacDonald

(57) ABSTRACT

Mass-produced fuel pumps having a stable pump efficiency comprising a circumferential groove 20 is formed within a pump body 15 and the groove 20 is divided into a first region having a constant cross-sectional area L, a second region having a cross sectional area that gradually becomes smaller toward the downstream side, and a third region having a constant cross-sectional area M. A suction hole 22 is formed within the pump body 15 and is inclined toward the rotational direction of the impeller. The suction hole 22 is communicated with the groove 20 in the first region. Even if the inclination angle of the suction hole 22 varies among mass-produced fuel pumps, the cross-sectional area L of the groove 20 is constant at the location where the suction hole 22 is communicated with the groove 20. Therefore, variations in the amount of fuel sucked into the fuel pump can be reduced. Accordingly, pump efficiency of the mass-produced fuel pumps can be stabilized.

2 Claims, 7 Drawing Sheets

FUEL PUMP

CROSS-REFERENCE

The present application claims priority based on Japanese Patent Application 2003-177906 filed on Jun. 23, 2003. The specification and figures of that Japanese application are hereby incorporated by reference within the specification and figures of the present application.

FIELD OF THE INVENTION

The present invention relates to a fuel pump for sucking a fuel such as gasoline etc., increasing the pressure thereof, and discharging the pressurized fuel.

BACKGROUND OF THE INVENTION

A known fuel pump comprises a substantially disk-shaped impeller and a casing. A pair of grooves is formed in a pair of interior surfaces of the casing and each groove extends continuously in a circumference direction from an up-stream end to a down-stream end. A suction hole is formed to pass through the casing for communicating the exterior of the casing to the up-stream end of the circumferential groove, and a discharge hole is formed to pass through the casing for communicating the down-stream end of the circumferential groove to the exterior of the casing. When the impeller is rotated within the casing, a fuel is sucked into the casing, the pressure thereof is increased within the casing and the pressurized fuel is discharged from the casing.

The cross-sectional area of the circumferential groove formed in the interior surface of the casing greatly affects the efficiency of the fuel pump. The fuel pump disclosed in Japanese Laid-Open Patent Publication 7-189975 divides the circumferential groove into a first region which is cross to the up-stream end and a second region which is cross to the down-stream end. In the first region, the cross-sectional area of the circumferential groove becomes smaller toward the down-stream side, while the cross-sectional area of the groove is constant in the second region.

SUMMARY OF THE INVENTION

The fuel pump, disclosed in Japanese Laid-Open Patent Publication 7-189975, is provided with the suction hole that extends in parallel with a rotational axis of the impeller. As a result, the suction hole and the circumferential groove intersect almost perpendicularly. When the suction hole and the circumferential groove intersect perpendicularly, the fuel tends to be trapped around a corner between the suction hole and the circumferential groove and the fuel does not flow smoothly from the suction hole to the circumferential groove.

In order to solve this problem, it may be possible to incline the suction hole toward a rotational direction of the impeller.

When the suction hole is inclined toward the rotational direction of the impeller, the fuel flow becomes smoother, however, the cross-sectional area of the circumferential groove at a location where the suction hole is communicated with the circumferential groove varies among mass-produced fuel pumps. When the suction hole is inclined at a greater angle than a standard and is communicated with the circumferential groove at a down-stream side of a standard position, the cross-sectional area of the circumferential groove at the location communicating with the suction hole becomes smaller than a standard. On the other hand, when the suction hole is inclined at a smaller angle than the standard and is communicated with the circumferential groove at an up-stream side of the standard position, the cross-sectional area of the circumferential groove at the location communicating with the suction hole becomes greater than the standard. In mass-production of fuel pumps, some tolerances with respect to the inclination angle of the suction hole cannot be avoided, therefore, the cross-sectional areas of the circumferential groove at the location communicating with the suction hole varies among the mass-produced fuel pumps. The pump efficiencies of the mass-produced fuel pumps do not stabilize if the fuel pumps adopt the structure in which the suction hole is inclined toward the rotational direction of the impeller and the inclined suction hole is communicated with the circumferential groove at a location where the cross-sectional area of the circumferential groove becomes smaller toward the down-stream side.

The main object of the present invention is to stabilize pump efficiencies of the mass-produced fuel pumps.

The fuel pump of the present invention is provided with a casing and a substantially disc-shaped impeller that rotates within the casing. A circumferential groove is formed in an interior surface of the casing and the groove extends continuously in a circumference direction from an up-stream end till a down-stream end. The groove is divided into a first region, a second region and a third region from the up-stream side toward the down-stream side. The cross-sectional area of the groove is constant in the first region. The cross-sectional area of the groove becomes smaller toward the down-stream side in the second region. The cross-sectional area of the groove is constant in the third region. A suction hole is formed to pass through the casing to communicate the exterior of the casing to the interior of the casing. The suction hole is inclined toward a rotational direction of the impeller and is communicated with the groove in the first region.

As disclosed in the prior art, when the suction hole is perpendicular to the circumferential groove, the fuel does not flow smoothly through the corner region between the suction hole and the circumferential groove, and the fuel tends to be trapped around the corner region. In the present invention, the suction hole is not perpendicular to the circumferential groove, instead the suction hole is inclined toward the rotational direction of the impeller, therefore, the fuel flows smoothly through the corner region between the suction hole and the circumferential groove, and the pump efficiency is improved.

The suction hole, which is inclined toward the rotational direction of the impeller, is communicated with the circumferential groove in the first region thereof. The circumferential groove in the first region has a constant cross-sectional area. Therefore, even if the inclination angle of the suction hole varies and the position where the suction hole is communicated with the circumferential groove varies among the mass-produced fuel pumps, the cross-sectional areas of the circumferential groove at the communicating position are constant among the mass-produced fuel pumps. Therefore, pump efficiencies are stabilized among the mass-produced fuel pumps.

It is preferred that the cross-sectional area of the first region of the circumferential groove is 1.2 to 3.8 times as large as that of the third region and that the length of the first region is 0.05 to 0.85 times as long as the total length of the first and the second regions of the circumferential groove.

The amount of fuel that is sucked into the casing can be increased to a maximum and optimal volume by setting the cross-sectional area of the first region to 1.2 to 3.8 times as large as that of the third region and by setting the length of the first region to 0.05 to 0.85 times as long as the total length of the first and the second regions. Pump efficiency can thus be effectively improved.

PREFERRED EMBODIMENT OF THE INVENTION

Preferred embodiments of the present invention are described below.

(Preferred Aspect 1)

It is preferred that a vapor jet to discharge vapor from a circumferential groove is communicated with the groove at the down-stream end of a second region.

The vapor within the fuel is carried to the down-stream end of the second region and is easily discharged to the exterior of the casing through the vapor jet at the down-stream end of the second region. When the vapor jet is formed at the down-stream end of the second region, the vapor can be easily removed from the fuel and pump efficiency can be improved.

Figure 1:
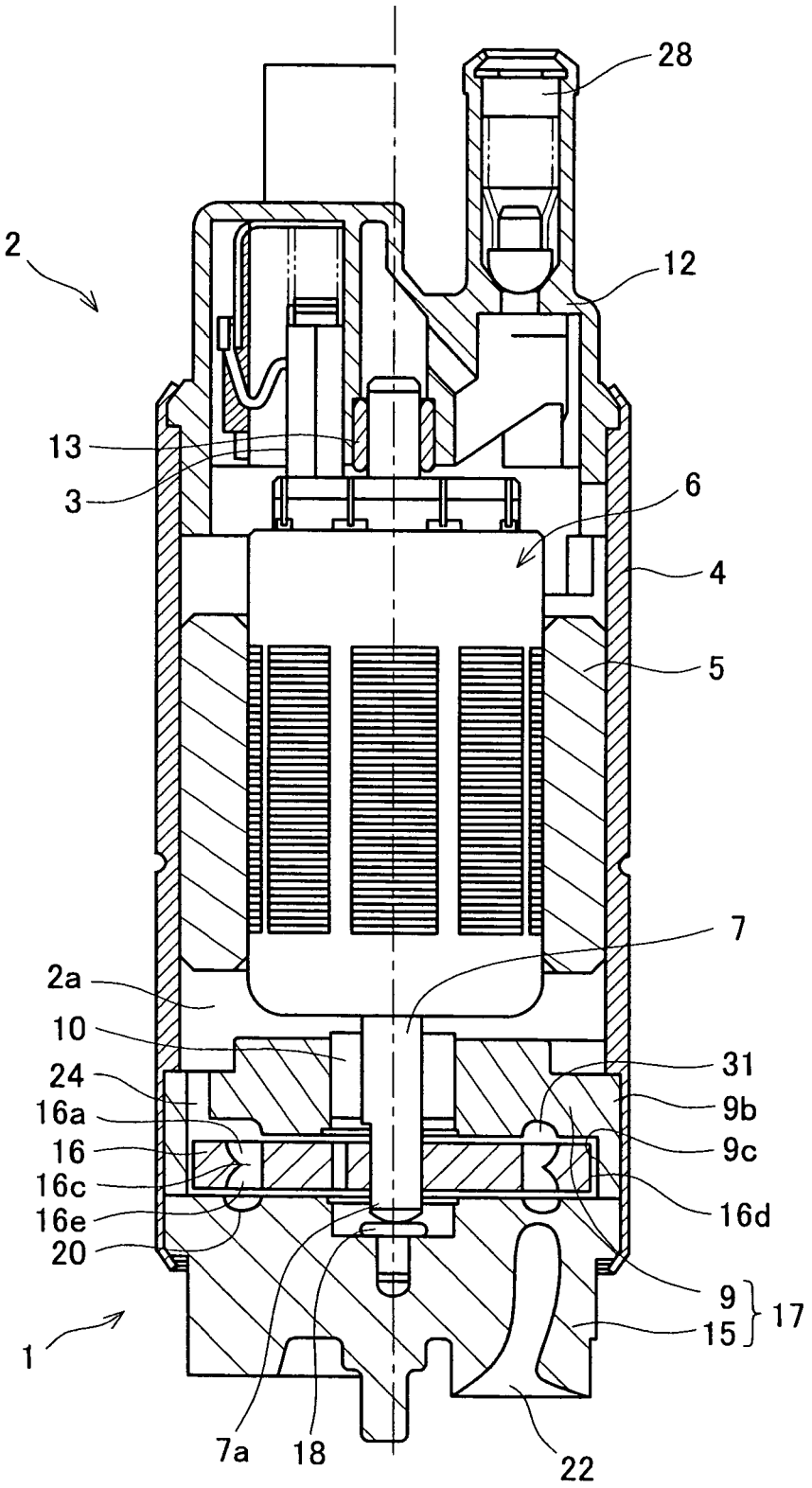
FIG. 1 shows a cross-sectional view of a fuel pump of a first embodiment.
Figure 2:
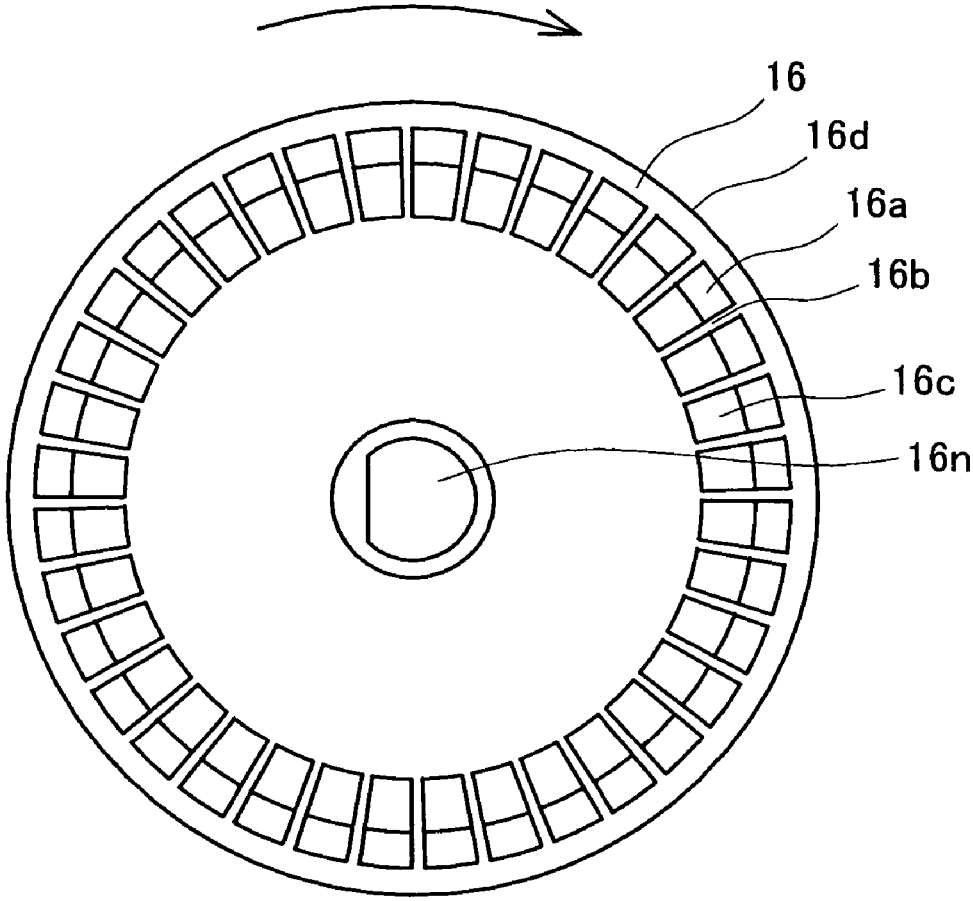
FIG. 2 shows a top plan view of an impeller of the first embodiment.
Figure 3:
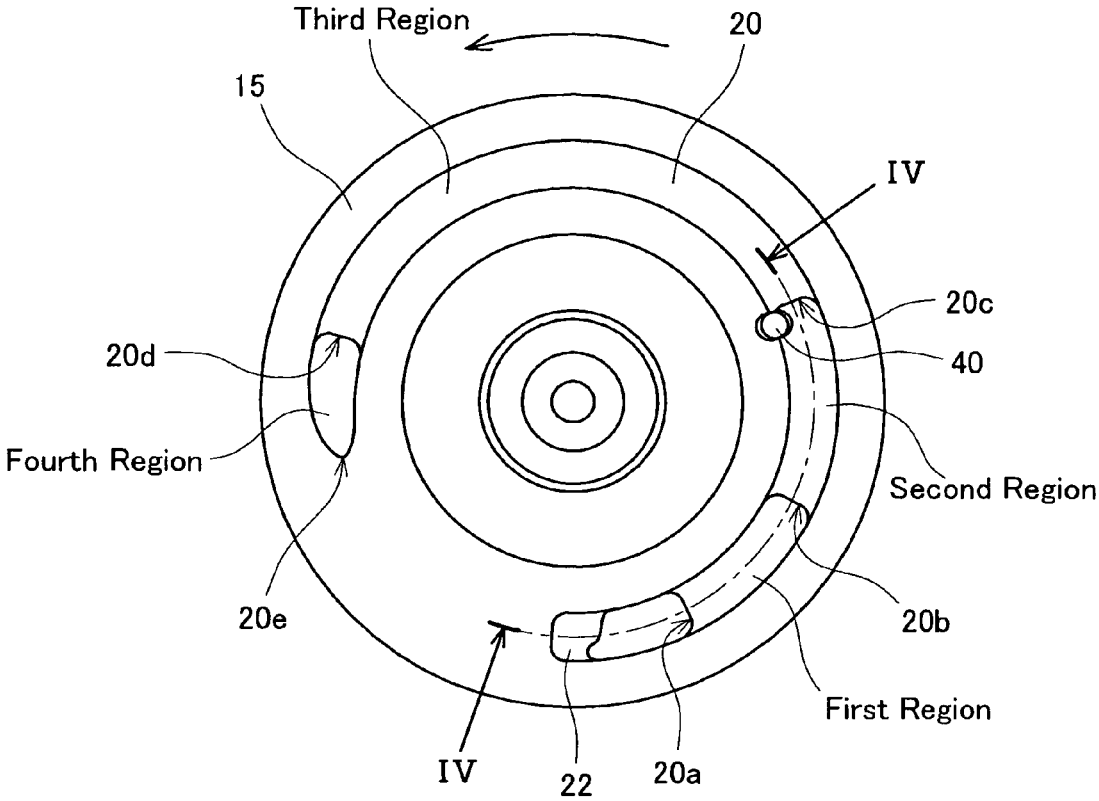
FIG. 3 shows a top plan view of a pump body of the first embodiment.
Figure 4:
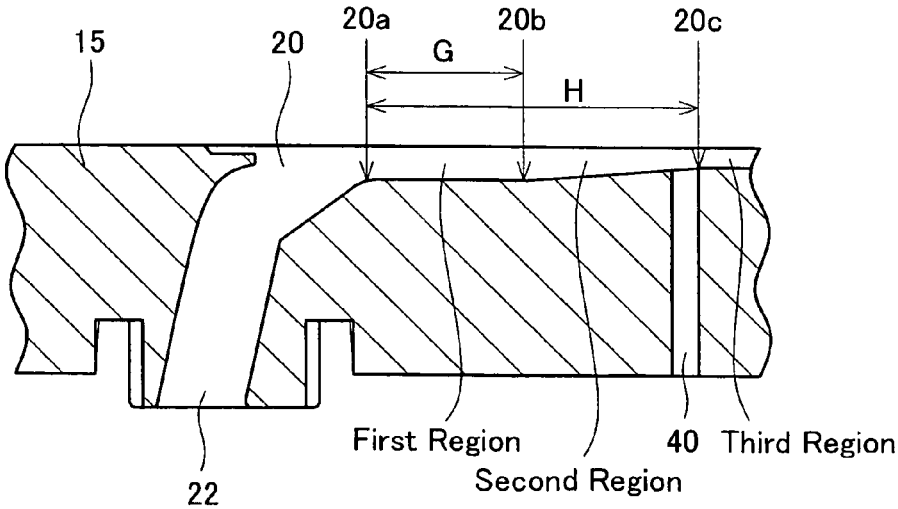
FIG. 4 shows a cross-sectional view of the pump body of FIG. 3 taken along line IV—IV.

A first embodiment of the present invention is described referring to FIGS. 1 to 4. FIG. 1 shows a longitudinal cross sectional view of a fuel pump of the present embodiment, FIG. 2 shows a top plan view of an impeller, FIG. 3 shows a top plan view of a pump body, and FIG. 4 shows a cross sectional view of the pump body of FIG. 3 taken along line IV—IV.

The fuel pump of the present embodiment is used in a motor vehicle, the fuel pump being utilized within a fuel tank and being utilized for supplying fuel to an engine of the motor vehicle. As shown in FIG. 1, the fuel pump is composed of a pump section 1 and a motor section 2 for driving the pump section 1. The motor section 2 is provided with a brush 3, a magnet 5 located within an approximately cylindrical housing 4, and a rotating member 6 concentric with the magnet 5. The motor section 2 comprises a direct current motor.

A lower portion of a shaft 7 of the rotating member 6 is rotatably supported, via a bearing 10, on a pump cover 9 attached to a lower end portion of the housing 4. Furthermore, an upper end portion of the shaft 7 is rotatably supported, via a bearing 13, on a motor cover 12 attached to an upper end portion of the housing 4.

The rotating member 6 is caused to rotate by means of conductively connecting a coil (not shown) of the rotating member 6 via the brush 3 and a terminal (not shown) provided in the motor cover 12 to an electric source (not shown). The configuration of this type of the motor section 2 is known in the art and a detailed description thereof is omitted. Further, a motor of a type differing from the type shown here may also be utilized.

The configuration of the pump section 1 that is driven by the motor section 2 is described next. The pump section 1 comprises the pump cover 9, a pump body 15, and an impeller 16, etc. The pump cover 9 and the pump body 15 are formed by, for example, die casting aluminum, and the two are fitted together to form a casing 17 wherein the impeller 16 is housed.

The impeller 16 is formed by means of resin molding. As shown in FIG. 2, the impeller 16 is substantially disc shaped. A group of concavities 16*a* is formed in an upper face of the impeller 16 in an area located inwardly from an impeller outer circumference face 16*d* by a predetermined distance. Adjacent concavities 16*a* are separated by a partitioning wall 16*b* that extends in the radial direction. The concavities 16*a* are repeated in the circumference direction. The group of concavities 16*a* extends along the circumference direction of the impeller 16. A group of concavities 16*e* is formed in a lower face of the impeller 16. The group of lower concavities 16*e* has the same configuration as of the group of upper concavities 16*a*. Bottom portions of the pair of upper concavities 16*a* and lower concavities 16*e* communicate via through-holes 16*c*.

An approximately D-shaped fitting hole 16*n* is formed in the center of the impeller 16. A fitting shaft member 7*a*—this being D-shaped in cross-section—at the lower end portion of the shaft 7 fits into the fitting hole 16*n*. By this means, the impeller 16 is connected with the shaft 7 in a manner allowing follow-up rotation whereby slight movement in the axial direction is allowed. The outer circumference face 16*d* of the impeller 16 is a complete circular face without irregularities.

As shown in FIG. 1, a groove 31 is formed in a lower face of the pump cover 9 in an area directly facing the group of concavities 16*a* in the upper face of the impeller 16, this groove 31 extending continuously in the rotational direction of the impeller 16 from an up-stream end to a down-stream end. A discharge hole 24 is formed in the pump cover 9, this discharge hole 24 extending from the down-stream end of the groove 31 to an upper face of the pump cover 9. The discharge hole 24 passes through the casing 17 from the interior to the exterior (an inner space 2*a* of the motor section 2) of the casing 17.

An inner circumference face 9*c* of a circumference wall 9*b* of the pump cover 9 faces, along the entire circumference of the pump cover 9, the impeller outer circumference face 16*d*, with a minute clearance therebetween. For the sake of clarity, the clearance is represented as larger in the figures than it is in reality.

The cross-sectional area of the groove 31 of the pump cover 9, in the vicinity of the down-stream end thereof, gradually becomes larger as it approaches the discharge hole 24. The groove 31 adjacent to the down-stream end is displaced towards the outer side in the radial direction, but remains within the area of the impeller outer circumference face 16*d*. A terminal portion of the discharge hole 24 is formed in the outer side, relative to the radial direction, of the area facing the group of concavities 16*a* of the impeller 16.

As shown in FIGS. 1 and 3, a groove 20 is formed in an upper face of the pump body 15 in an area directly facing the group of concavities 16*e* in the lower face of the impeller 16. The groove 20 extends continuously along the rotational direction of the impeller 16 from an up-stream end 20*a* to a down-stream end 20*e*. A suction hole 22 is formed in the pump body 15, the suction hole 22 extending from the up-stream end 20*a* of the groove 20 to a lower face of the pump body 15. The suction hole 22 passes through the casing 17 from the exterior to the interior of the casing 17. The detail of the groove 20 will be described later.

The pump body 15, this being in a superposed state with the pump cover 9, is attached by means of caulking or the like to the lower end portion of the housing 4. A thrust bearing 18 is fixed to a central portion of the pump body 15. The thrust load of the shaft 7 is received by the thrust bearing 18.

In FIG. 1, for the sake of clarity, each clearance is represented as larger than it is in reality. The groove 20 of the pump body 15 does not communicate directly with the discharge hole 24. The circumference wall 9*b* of the pump cover 9 is adjacent to the impeller outer circumference face 16*d* even at the location of the discharge hole 24, and the groove 20 and the discharge hole 24 do not actually communicate at the outer side of the impeller outer circumference face 16*d*. The groove 20 and the discharge hole 24 communicate only by means of the through-holes 16*c* of the impeller 16.

The groove 31 extending in the circumference direction of the pump cover 9, and the groove 20 extending in the circumference direction of the pump body 15 extend along the rotational direction of the impeller 16, and extend from the suction hole 22 to the discharge hole 24. When the impeller 16 rotates, the fuel within the fuel tank is sucked into the casing 17 from the suction hole 22. A portion of the fuel sucked into the casing 17 from the suction hole 22 flows along the groove 20 and the concavities 16*e*. The remaining portion of the fuel sucked into the casing 17 passes through the through-holes 16*c* of the impeller 16 and enters the groove 31 and the concavities 16*a*. The fuel entered to the groove 20 and the groove 31 flows along the groove 20 and the groove 31 respectively, while a revolving current of the fuel is being caused to occur within these concavities 16*e* and 16*a* respectively. The pressure of the fuel rises as it flows along the grooves 20 and 31. The fuel that has flowed along the groove 20 and has been pressurized passes through the through-holes 16*c* of the impeller 16 and merges with the fuel that has been pressurized in the groove 31. The fuel that has flowed along the grooves 20, 31 and has been pressurized is delivered from the discharge hole 24 to the motor section 2. The highly pressurized fuel delivered to the motor section 2 is delivered to the exterior of the fuel pump from a discharge port 28 of the motor cover 12.

As shown in FIG. 3, the groove 20 is not formed over the entire circumference of an end face of the pump body 15. The groove 20 is not formed in a region between the down-stream end 20*e* and the up-stream end 20*a*.

As shown in FIGS. 3 and 4, the groove 20 of the pump body 15 is divided into 4 subsections and changes its cross-sectional area at three locations.

The groove 20 merges with the suction hole 22 at the up-stream end 20*a*, and then extends to a first midpoint 20*b* toward the down-stream side with a constant cross-sectional area L. A region between the up-stream end 20*a* and the first midpoint 20*b* shall be a first region.

The cross-sectional area of the groove 20 gradually becomes smaller from the first midpoint 20*b* to a second midpoint 20*c* adjacent to an opening of a vapor jet 40. A region between the first midpoint 20*b* and the second midpoint 20*c* shall be a second region.

The groove 20 extends from the second midpoint 20*c* to a third midpoint 20*d* toward the down-stream side. The groove 20 has a constant cross-sectional area M between the second midpoint 20*c* and the third midpoint 20*d*. A region between the second midpoint 20*c* and the third midpoint 20*d* shall be a third region.

The cross-sectional area of the groove 20 gradually becomes smaller from the third midpoint 20*d* to the down-stream end 20*e*. A region between the third midpoint 20*d* and the down-stream end 20*e* shall be a fourth region.

The first region of the groove 20 has a constant cross-sectional area L. Even if the location where that suction hole 22 communicates with the groove 20 varies, the cross-sectional area of the groove 20 at the location communicating with the suction hole 22 is constant. Therefore, the amount of fuel that is sucked into the casing 17 is stabilized without variation.

The cross-sectional area L of the first region is larger than the cross-sectional area M of the third region. The up-stream end 20*a* is a merging point of the circumferential groove 20 and the suction hole 22. Large cross-sectional area L of the first region secures a wide fuel passage, and therefore, a large amount of fuel can be sucked into the casing 17 smoothly.

The cross-sectional area of the second region gradually becomes smaller from the cross-sectional area L of the first region to the cross-sectional area M of the third region. The fuel is pressurized by gradually reducing the cross-sectional area of the groove 20. Further, when the fuel is depressurized within the suction hole 22 and generates vapor, vapor can be discharged to the exterior of the casing 17 from the vapor jet 40, which is opened at the down-stream end of the second region (the second midpoint 20*c*).

In the fourth region, the fuel that has flowed toward the down-stream end 20*e* smoothly flows into communicating holes 16*c* of the impeller 16 (See FIG. 1).

The cross-sectional area of the circumferential groove does not stabilize at the location where the suction hole is communicated the groove, if the suction hole is inclined toward the rotational direction of the impeller and the suction hole is communicated with the groove having a cross-sectional area that becomes smaller toward the down-stream side. The mass-production of fuel pumps must accept variations in the inclination angle of the suction hole, and in the cross-sectional area decreasing rate of the circumferential groove toward the down-stream side.

In the fuel pump of the present embodiment, the suction hole 22 is communicated with the groove 20 in the region where the cross-sectional area of the groove is constant (the first region). Therefore, even if there are variations in the inclination angles of the suction holes 22, the groove has a constant cross-sectional area L at the location where the suction hole 22 communicates with the groove. Accordingly, variations in the amount of fuel that is sucked into the fuel pump can be reduced and thus, pump efficiencies among the mass-produced fuel pumps can be stabilized.

In the fuel pump of the present embodiment, the groove 20 has a configuration as described above. Accordingly, the large amount of fuel can be smoothly sucked into the fuel pump and pump efficiency can be improved.

Figure 5:
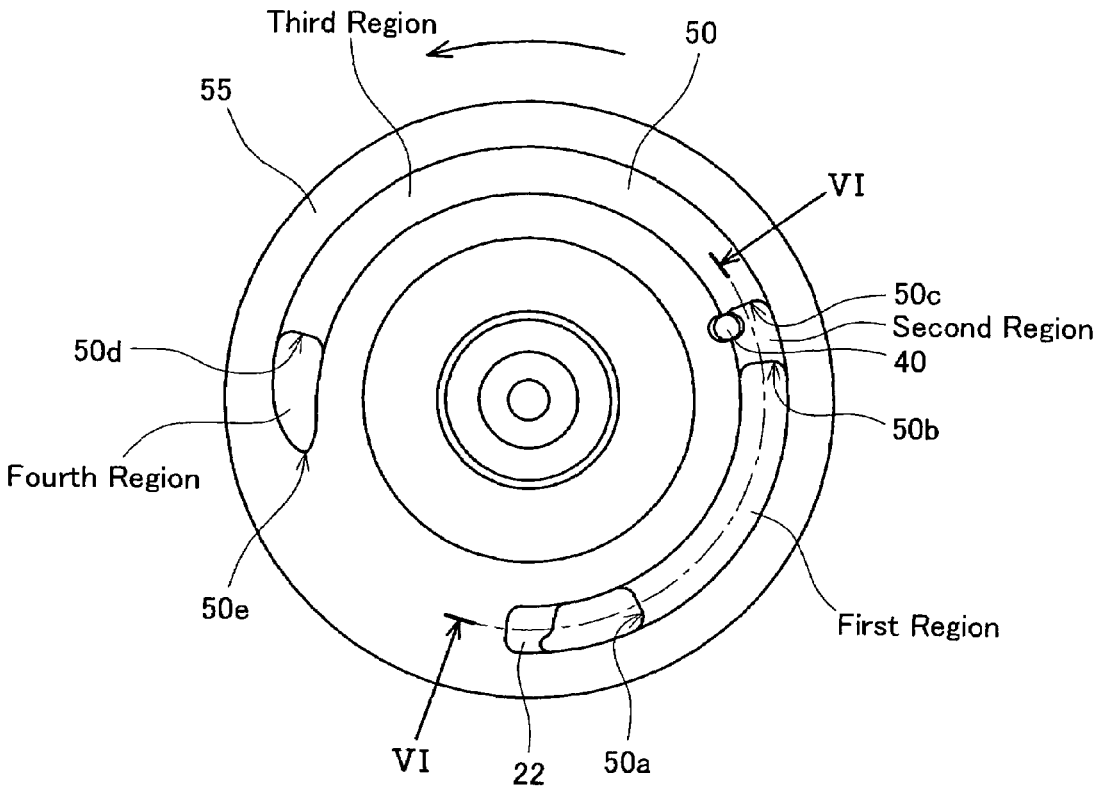
FIG. 5 shows a top plan view of the pump body of a second embodiment.
Figure 6:
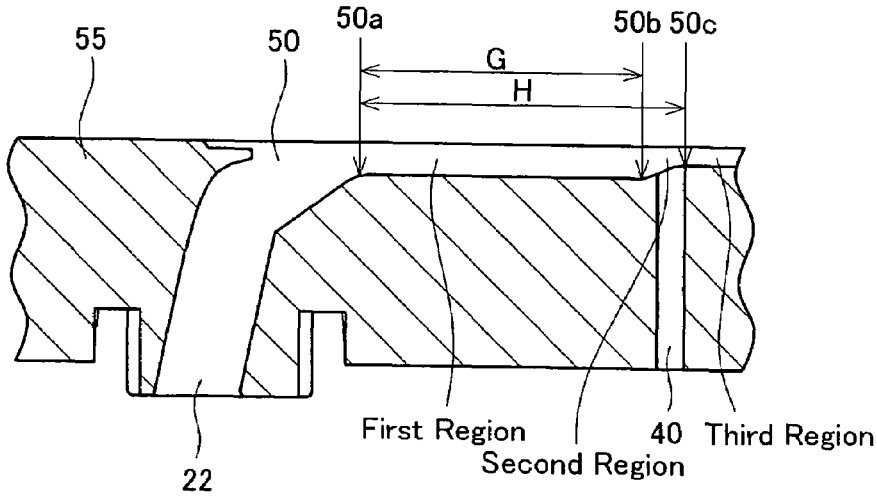
FIG. 6 shows a cross-sectional view of the pump body of FIG. 5 taken along line VI—VI.

A second embodiment of the present invention is now described referring to FIGS. 5 and 6. FIG. 5 shows a top plan view of a pump body 55 and FIG. 6 shows a cross-sectional view of the pump body 55 of FIG. 5 taken along line VI—VI. The fuel pump of the present embodiment has a configuration approximately identical with that of the fuel pump of the first embodiment; only the shape of the groove 50 of the pump body 55 differs. Consequently, only the shape of the groove 50 of the pump body 55 will be described here and a description of identical components is omitted. The same numerals are used for the components identical to the first embodiment.

As shown in FIG. 5, the groove 50 is formed on an end face of the pump body 55. The end face directly faces a lower end face of an impeller (not shown). As shown in FIGS. 5 and 6, the cross-sectional area of the groove 50 of the pump body 55 changes at three locations, just like the groove 20 of the pump body 15 of the first embodiment. The groove 50 is divided into a first region, a second region, a third region and a fourth region.

After merging with the suction hole 22 at an up-stream end 50*a*, the groove 50 is formed to extend to a first midpoint 50*b* toward the down-stream side with a constant cross-sectional area L. A region between the up-stream end 50*a* and a first midpoint 50*b* is the first region. The first midpoint 50*b* is located at the upper-stream side adjacent to the vapor jet 40. That is, the groove 50 extends from the up-stream end 50*a* to the upper-stream side of the vapor jet 40 with a constant cross-sectional area L.

The cross-sectional area of the groove 50 gradually becomes smaller from the first midpoint 50*b* to a second midpoint 50*c*. A region between the first midpoint 50*b* and the second midpoint 50*c* is the second region. The second midpoint 50*c* is located at a lower-stream side of the vapor jet 40. That is, the cross-sectional area of the groove 50 gradually becomes smaller within the short second region, which is from the upper-stream side to the lower-stream side, both being adjacent to the vapor jet 40.

The groove 50 extends from the second midpoint 50*c* to a third midpoint 50*d* toward the down-stream side and is formed with a constant cross-sectional area M. A region between the second midpoint 50*c* and the third midpoint 50*d* is the third region.

The cross-sectional area of the groove 50 gradually becomes smaller from the third midpoint 50*d* to the down-stream end 50*e* and a region between the third midpoint 50*d* and the down-stream end 50*e* is the fourth region.

The cross-sectional area L at the first region and the cross-sectional area M at the third region have the same values with those in the first embodiment. Further, the third and fourth regions have the same configurations in the first and the second embodiments.

At the first midpoint 50*b* and the second midpoint 50*c* where the value of the cross-sectional area greatly changes, the bottom faces of the first and second regions, as well as the bottom faces of the second and third regions, form acute angles. It is preferred that a preprocessing, such as chamfering, is applied to bottom faces at the first and second midpoints 50*b* and 50*c*, so that the fuel flow will not be disrupted.

In the fuel pump of the present embodiment, the suction hole 22 is communicated with the circumferential groove 50 in the region where the cross-sectional area of the circumferential groove is constant (the first region). Therefore, even if there are variations in the inclination angles of the suction holes 22, the groove has a constant cross-sectional area L at the location where the suction hole 22 communicates with the circumferential groove. Accordingly, variations in the amount of fuel that is sucked into the fuel pump can be reduced and thus, pump efficiency can be stabilized among mass-produced fuel pumps.

Further, in order to improve pump efficiency, it is important to set a ratio (L/M) of the cross-sectional area L at the first region L to the cross-sectional area M at the third region at a proper value.

Further, the length of the first region in the second embodiment is long when compared to the same in the first embodiment. The length of the second region in the second embodiment is short when compared to the same in the first embodiment. In order to improve pump efficiency, it is also important to set a ratio (G/H) of the length G of the first region to the total length H of the first and the second regions at a proper value.

Figure 7:
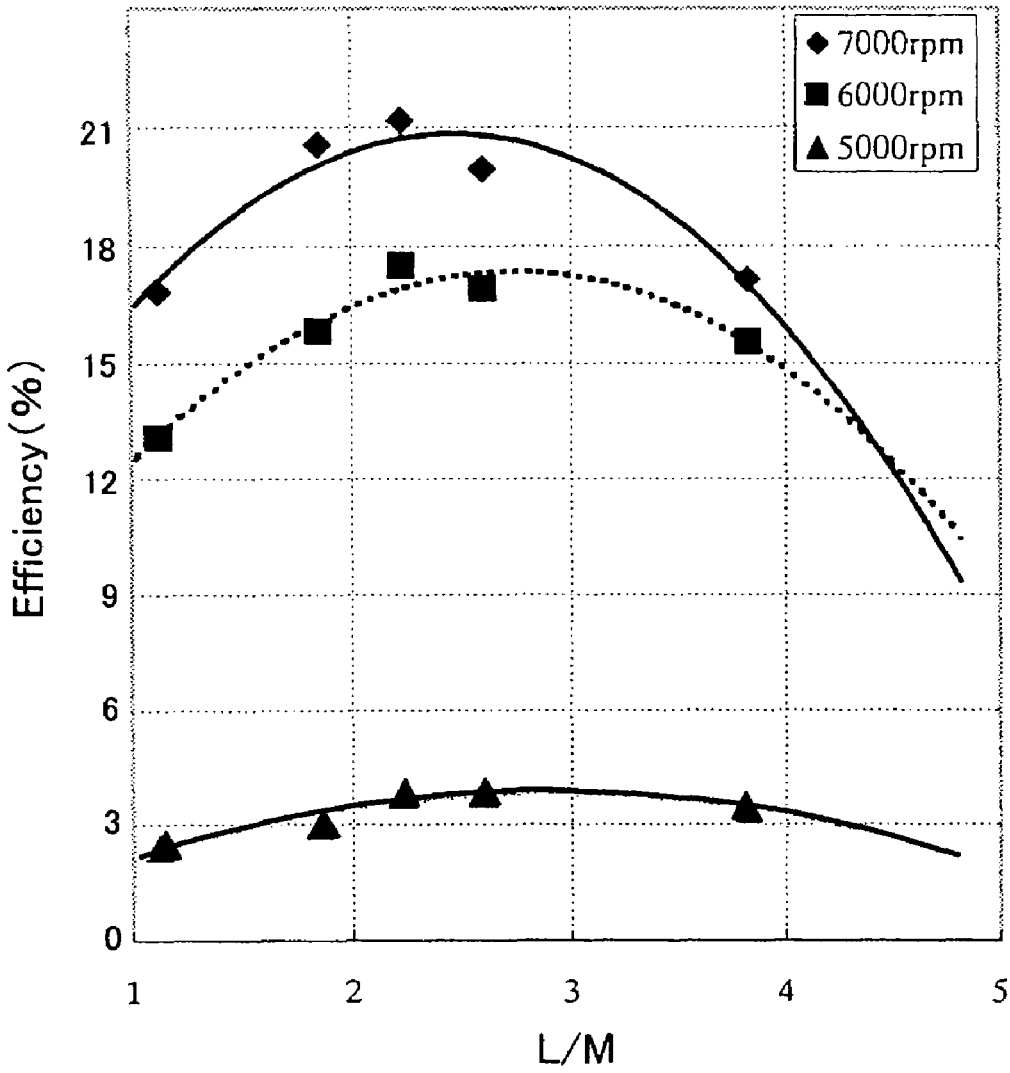
FIG. 7 is a graph showing changes in pump efficiencies by a ratio of the cross-sectional area.

FIG. 7 is a graph showing changes in the pump efficiency by the ratio of the cross-sectional area L to the cross-sectional area M, wherein G/H is set to 0.201. In all cases wherein pump revolutions per minute is 5000 rpm, 6000 rpm, and 7000 rpm, pump efficiency remains good while L/M is within a range of 1.2 to 3.8. Pump efficiency will reach its maximum when L/M is within a range of 2.5 to 3.

Figure 8:
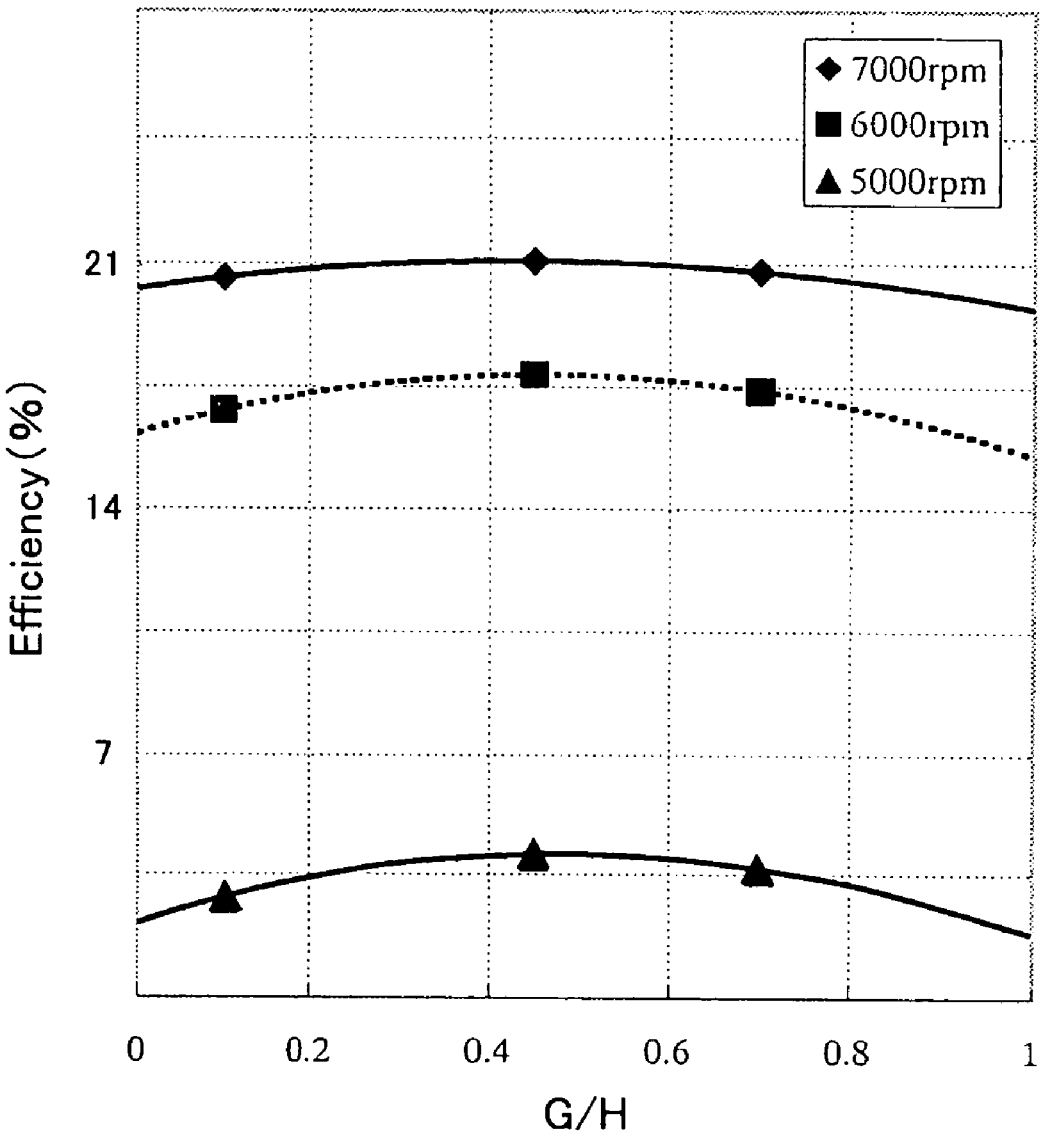
FIG. 8 is a graph showing changes in pump efficiencies by a ratio of the length in the circumference direction.

FIG. 8 is a graph showing changes in the pump efficiency by the ratio of the length G to the length H, wherein L/M is set at 1.8. In all cases wherein pump revolutions per minute is 5000 rpm, 6000 rpm, and 7000 rpm, pump efficiency remains good while G/H is within a range of 0.05 to 0.85. Pump efficiency will reach its maximum when G/H is within a range of 0.4 to 0.5.

As described above, by setting both L/M and G/H to be the proper values, the largest and the most appropriate amount of fuel can be sucked into the fuel pump and pump efficiency can be increased regardless of the speed of the rotation of the fuel pump.

Figure 9:
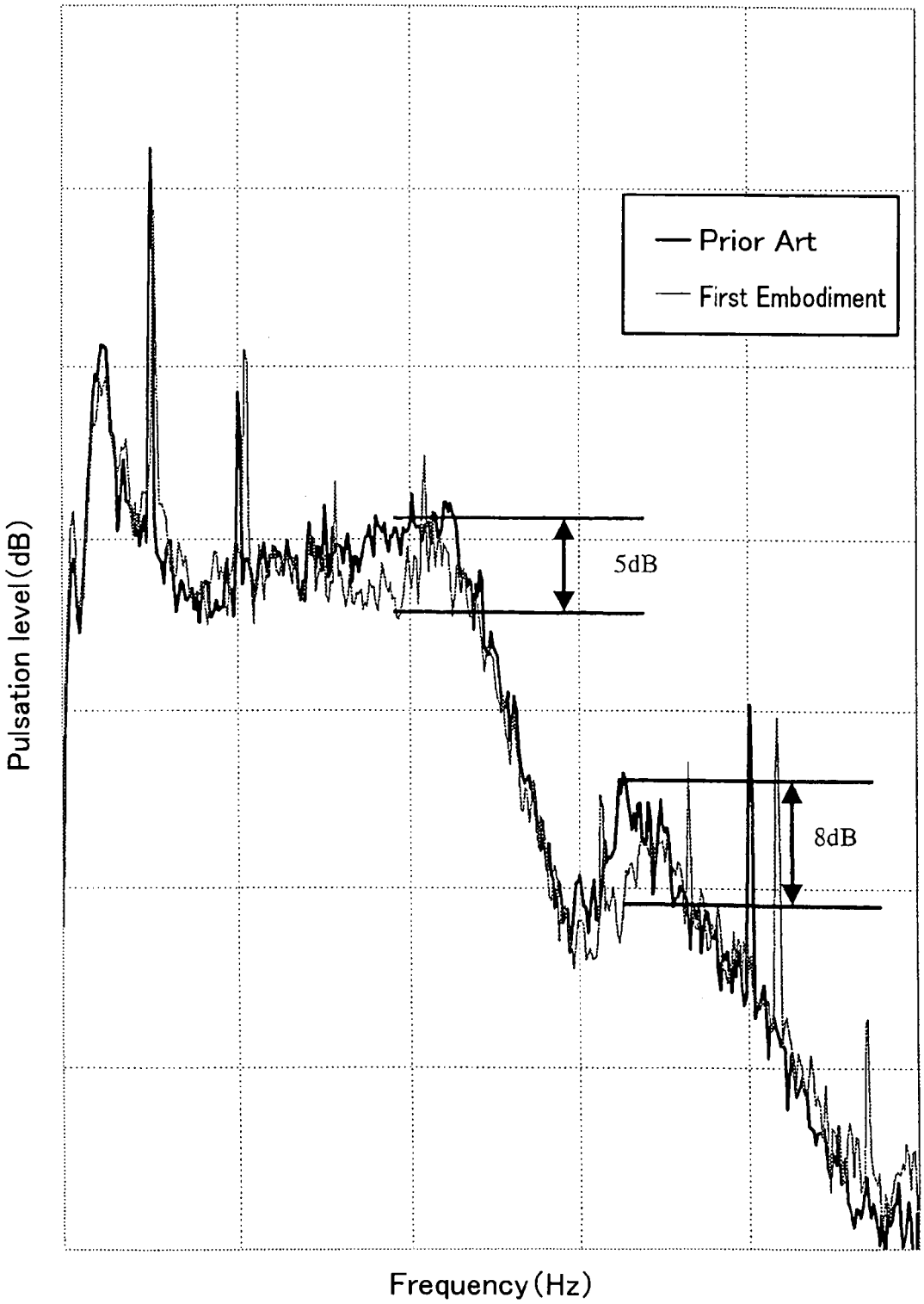
FIG. 9 is a graph that compares pump noise of a known fuel pump and the fuel pump of the present invention.

FIG. 9 is a graph that compares pump noises of the known fuel pump and the fuel pump of the first embodiment. A graph in a bold solid line shows the know fuel pump, while a graph in a narrow solid line shows the first embodiment. The known fuel pump is louder than the fuel pump of the first embodiment at any frequency. The largest difference is 8 db.

Operational noise of the pump has been minimized by the groove having a configuration that satisfies the proper L/M and G/H. This also verifies the fact that the appropriate amount of fuel is sucked into the fuel pump and the fuel flow is rendered smooth.

The present invention relates to the fuel pump having the suction hole inclined toward the rotational direction of the impeller, so that fuel can be easily sucked into the groove from the suction hole. The large amount of fuel can be sucked into the fuel pump by forming smooth fuel flow. Cross-sectional area of the circumferential groove is constant at the location where the suction hole is communicated with the groove regardless of variation in the inclining angle of the suction hole. Accordingly, variation of the cross-sectional area of the groove at the location where the suction hole is communicated with the groove is stable and the amount of fuel sucked into the fuel pump can be is also stable. Thus, pump efficiencies of mass-produced fuel pumps can be stabilized.

Specific examples of embodiments of the present invention are presented above, but these merely illustrate some possibilities of the invention and do not restrict the claims thereof. The art set forth in the claims includes various transformations and modifications to the specific examples set forth above.

Furthermore, the technical elements disclosed in the present specification or figures may be utilized separately or in all types of conjunctions and are not limited to the conjunctions set forth in the claims at the time of submission of the application. Furthermore, the art disclosed in the present specification or figures may be utilized to simultaneously realize a plurality of aims or to realize one of these aims.

The invention claimed is:

1. A fuel pump, comprising a casing and a substantially disc-shaped impeller rotating within the casing; wherein a groove is formed within the casing and extends along a circumference direction, the groove is divided into a first, a second and a third region from the up-stream side toward the down-stream side, the first region has a constant cross-sectional area thereof, the second region has a cross-sectional area which becomes smaller toward the down-stream side, the third region has a constant cross-sectional area, a suction hole is formed to pass through the casing from the exterior of the casing to the interior of the casing, the suction hole is inclined toward a rotational direction of the impeller, and the suction hole is communicated with the groove in the first region.

2. A fuel pump as set forth in claim 1, wherein the cross-sectional area of the first region is 1.2 to 3.8 times as large as that of the third region, and length of the first region is 0.05 to 0.85 times as long as the total length of the first and the second regions.

* * * * *